US009888739B2

(12) United States Patent
Dakhil

(10) Patent No.: US 9,888,739 B2
(45) Date of Patent: Feb. 13, 2018

(54) THERMAL FOOTWEAR

(71) Applicant: Farouk Dakhil, Rome (IT)

(72) Inventor: Farouk Dakhil, Rome (IT)

( * ) Notice: Subject to any disclaimer, the term of this patent is extended or adjusted under 35 U.S.C. 154(b) by 841 days.

(21) Appl. No.: 14/465,977

(22) Filed: Aug. 22, 2014

(65) Prior Publication Data

US 2016/0051006 A1 Feb. 25, 2016

(51) Int. Cl.

| | |
|---|---|
| ***H05B 3/00*** | (2006.01) |
| ***H01L 35/30*** | (2006.01) |
| ***A43B 7/02*** | (2006.01) |
| ***A43B 7/04*** | (2006.01) |

(52) U.S. Cl.
CPC ..... *A43B 7/04* (2013.01); *A43B 7/02* (2013.01); *A43B 7/025* (2013.01)

(58) Field of Classification Search
CPC ..... A43B 7/02; A43B 7/025; A43B 7/04
USPC ..... 219/211; 36/2.6
See application file for complete search history.

(56) References Cited

U.S. PATENT DOCUMENTS 3,648,469 A * 3/1972 Chapman ..... A47G 9/1036 165/135
4,644,801 A * 2/1987 Kustanovich ..... G01L 1/146 361/283.1
5,367,788 A * 11/1994 Chen ..... A43B 3/0005 36/2.6
5,495,682 A * 3/1996 Chen ..... A43B 3/0005 219/211
5,813,142 A * 9/1998 Demon ..... A43B 3/0005 36/28
2014/0043128 A1* 2/2014 Goldbaum ..... H01F 27/00 336/186
2014/0326287 A1* 11/2014 Wiant ..... H01L 35/32 136/205
2014/0327320 A1* 11/2014 Muhs ..... H04B 5/0037 307/104

* cited by examiner

*Primary Examiner* — Sang Y Paik
(74) *Attorney, Agent, or Firm* — Maier & Maier, PLLC

(57) ABSTRACT

An article and system for regulating temperature in footwear. Thermal footwear may include a power generation layer, a thermocell layer, and an accessory layer. The power generation layer may be constructed of an actuator material—for example, a dielectric elastomer—which may generate an electric current when compressed or decompressed. The thermocell layer may be configured to either warm or cool a user's foot, and may be reversible by being removably coupled to the power generation layer. The accessory layer may include other components; for example, an integrated circuit chip for power transmission to an external device may be included.

18 Claims, 8 Drawing Sheets

THERMAL FOOTWEAR

BACKGROUND

There are many people who suffer from having cold feet in winter, and others who suffer from having feet which are too warm and/or sweat during the summer. Many of these people attempt to treat such discomfort with a multiplicity of shoes designed for the different environments: warmer shoes for colder days and cooler shoes for warmer days. This has the potential to lead to excessive waste; for example, younger children often need shoes for one particular season and then grow out of them before they have a chance to wear them next season, leading to those shoes being discarded.

Additionally, there are health benefits to properly protecting feet, which may include properly regulating their temperature. Warming feet during the winter, for example, may help blood circulation and prevent or help recovery from colds or the flu. Overly warm feet in the summer can create a favorable environment for fungi or other microbes to grow in a warm and humid shoe. Footwear with insufficient cushioning can lead not only to pain in the feet, but also lower back pain, spinal stenosis, and some spinal cord problems. Various orthotics, including specially-designed footwear and inserts, exist to combat several of these conditions, but none satisfactorily deal with all of them.

SUMMARY

An article and system for regulating temperature in footwear may be described. Thermal footwear may include a power generation layer, a thermocell layer, and an accessory layer. The power generation layer may be constructed of an actuator material; for example, a dielectric elastomer, which may generate an electric current when compressed or decompressed, may be used. The thermocell layer may be configured to either warm or cool a user's foot, and may be reversible by being removably coupled to the power generation layer. The accessory layer may include other components; for example, an integrated circuit chip for power transmission to an external device may be included.

BRIEF DESCRIPTION OF THE FIGURES

Advantages of embodiments of the present invention will be apparent from the following detailed description of the exemplary embodiments. The following detailed description should be considered in conjunction with the accompanying figures in which.

Exemplary

Exemplary

Exemplary

Exemplary

Exemplary

Exemplary

Exemplary

Exemplary

DETAILED DESCRIPTION

Figure 1:
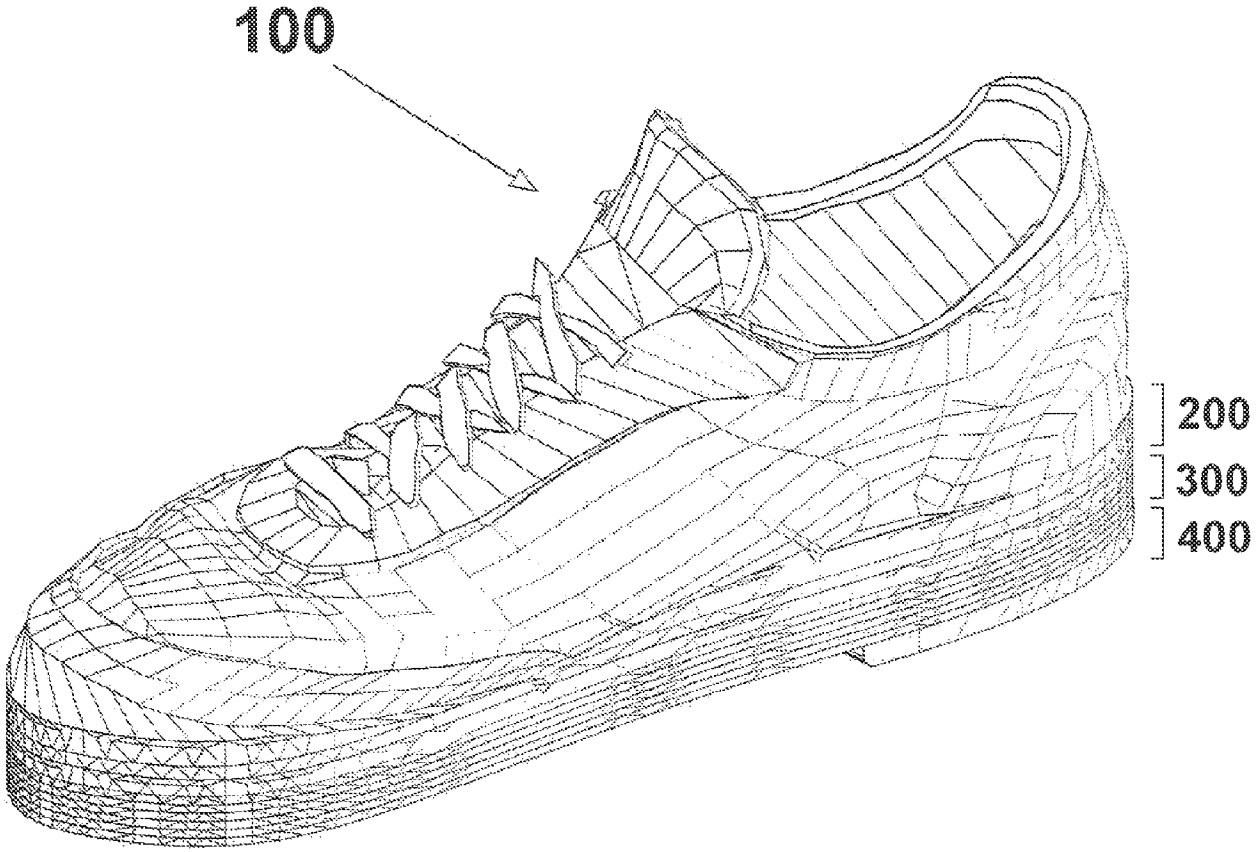
FIG. 1 shows a thermal footwear shoe with power generation and thermocell layering.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description, discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Dielectric elastomers (DEs) are special polymeric materials that, when deformed by an external mechanical force, produce, when paired with the appropriate electronics, an electric current. As the shape of the elastomer changes, the effective capacitance of the device under the external force deformation also changes, and, hence, electrical power can be obtained. This may allow users to generate a quantity of electrical power through the use of mechanical work, which may include a user simply walking from one point to another, raising and lowering their feet as they go. A floor, or, conversely, the sole of a shoe layered with dielectric elastomeric materials may deform if the user places the weight of their foot on a patch of the floor or the sole of the shoe, and may resume its original shape once the user has lifted their foot off of the ground; this deformation-restoration action may generate electrical power that may be harnessed by a device connected to the floor or the shoe.

The concept of dielectric elastomers was historically first discovered around 1775 by the French physicist Nicolas-Philippe Ledru. Among other achievements, Ledru discovered that a substance or a material can be deformed or altered in volume, length or width by an electric current. In particular, Ledru noticed that mercury, in a temperature column, would rise if current was applied. Then, in 1776, Italian Alessandro Volta explained the volume changes in a Leyden jar when an electric current passed through it, and was the first to give the right interpretation of this phenomenon. Later, in 1880, German physicist Wilhelm Conrad Röntgen described how a rubber substance would increase in length if current was applied to it. This was the birth of the so-called actuators and electroactive polymers of today's understanding. More recently, researchers such as Ron Pelrine and R. D. Kornbluh have contributed to the field, allowing for the efficient generation of power with high-density DE material through compression and decompression.

The power generation of the DE is governed by the equation: $P_{eq}=\in_0\in_r V^2/Z^2$. Solving for $V^2$, $V^2=Z^2P_{eq}/\in_0\in_r$, where $P_{eq}$ is the equivalent electromechanical pressure, V is the voltage and $\in_0$ is the vacuum permittivity, $\in_r$ is the dielectric constant of the material, and Z is the thickness of the elastomer material. (The equivalent electromechanical pressure $P_{eq}$ is twice the electrostatic pressure $P_{el}$).

Electricity may be used to power a thermocell. In 1805 Jean Charles Athanase Peltier discovered the so-called "Peltier effect" with regards to using different metals and materials in conducting an electrical current. Peltier found that when using different materials—e.g. copper and iron-constantan—in one and the same direct current circuit, at one welding junction between the two materials a drop in temperature was recorded and at another a rise in temperature was recorded. The location of the lowered/raised temperature depended on the direction of the current. This effect was then used in building first-generation refrigerators.

According to at least one exemplary embodiment, an article and system for regulating temperature in footwear may be described. Thermal footwear may include a power generation layer, a thermocell layer, and an accessory layer. The power generation layer may be constructed of an actuator material—for example, a dielectric elastomer—which may generate an electric current when compressed or decompressed. The thermocell layer may be configured to either warm or cool a user's foot, and may be reversible by being removably coupled to power generation layer. The accessory layer may include other components; for example, an integrated circuit chip for power transmission to an external device may be included.

Referring to exemplary FIG. 1, an article of thermal footwear 100 may include a thermocell layer 200, a power generation layer 300, and an accessory layer 400. Footwear 100 may be any type of suitable footwear. Only a standard lace-up sneaker is shown in exemplary FIG. 1 for simplicity, but footwear 100 may also be a more formal shoe, a child's shoe, a sandal, flip-flops, a boot, or any other footwear, as desired.

Figure 2:
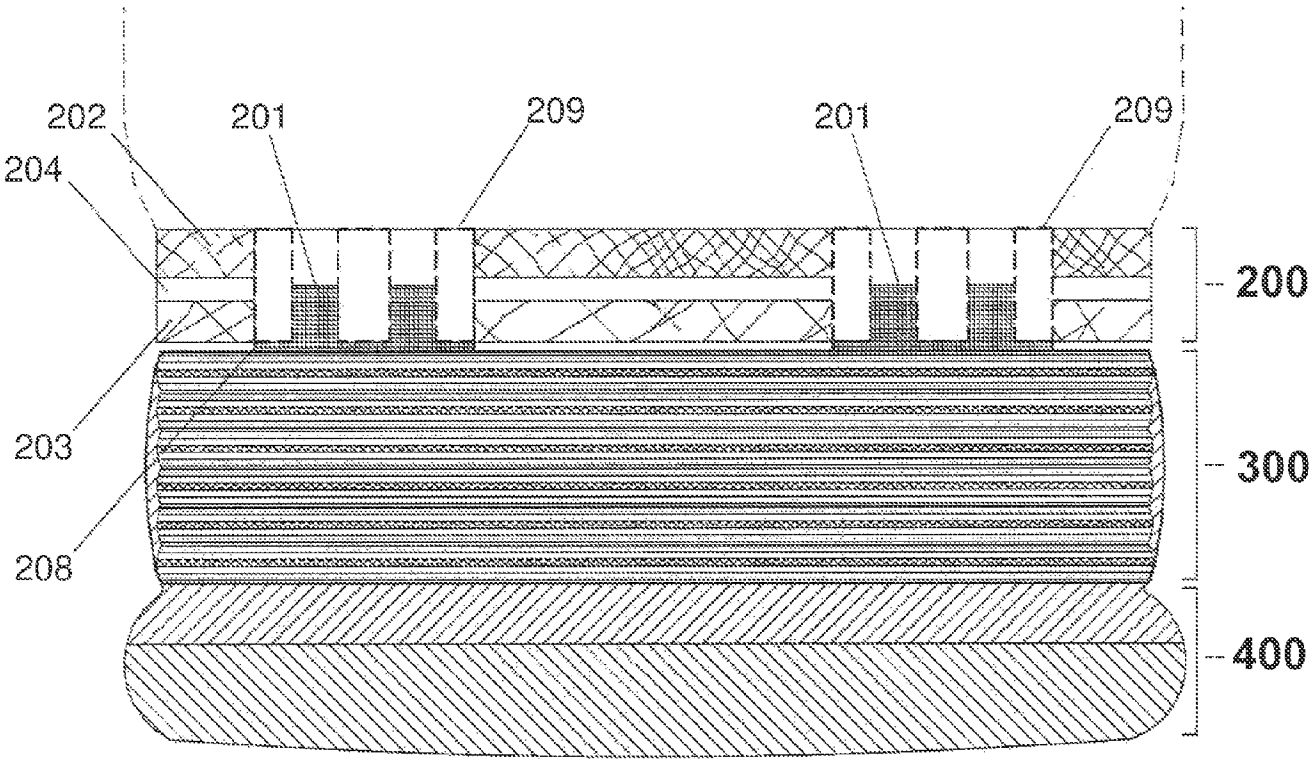
FIG. 2 shows a cross-section of a thermal footwear shoe with power generation and thermocell layering.

Exemplary FIG. 2 shows a cross-section of the sole of a piece of footwear 100, showing the thermocell layer 200, power generation layer 300, and accessory layer 400. Thermocell layer 200 may include two different conductors 202 and 203. Conductors 202, 203 may be constructed of any suitable material, for example two different compositions of carbon nanotubes. Conductors 202, 203 may be separated by insulator 204. One or more junction boxes 209 may provide for an electric current to pass through thermocell layer 200. A junction box 209 may have sockets into which electrodes 201 may be inserted. Electrodes 201 may be affixed to baseplate 208, and baseplate 208 may be affixed to and be electrically coupled to power generation layer 300. Electrodes 201 may be inserted into sockets in junction box 209 to create a connection. Electrodes 201 may be shaped and sized such that electrodes 201 only fit approximately halfway through the sockets, but remain in sufficient contact with junction box 209 to create a secure N-P junction.

Figure 2A:
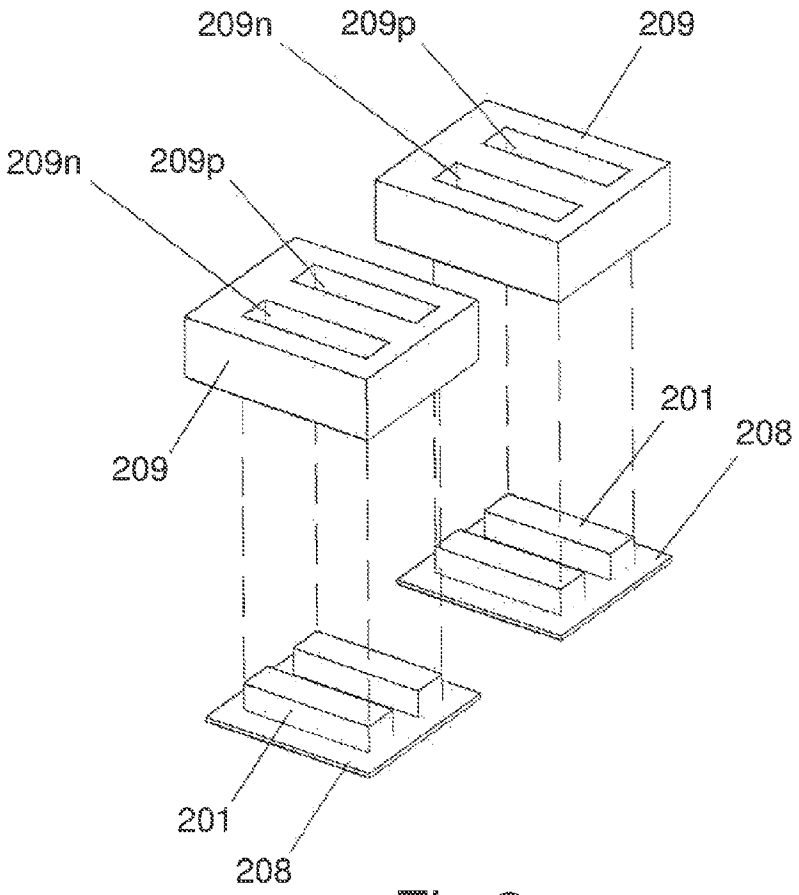
FIG. 2*a* shows a 3-D detail of the P-N junctions which may be used in thermal footwear.

Now referring to exemplary FIG. 2*a*, further detail for the arrangement of junction boxes 209, electrodes 201, and baseplate 208 may be shown. Each junction box 209 may include at least two sockets 209*n*, 209*p* into which two electrodes 201 may fit. Electrodes 201, junction box 209, and sockets 209*n*, 209*p* may be configured to create an N-P junction when current is passed through the elements.

Figure 2B:
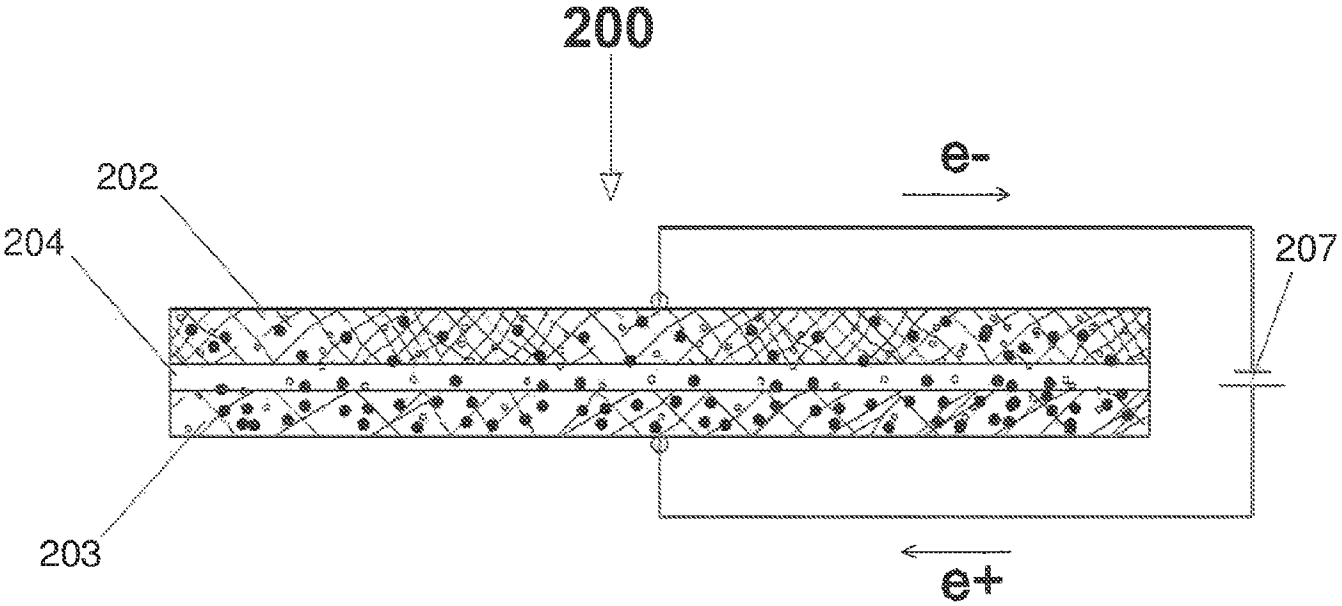
FIG. 2*b* shows a schematic diagram of a thermocell.

Now referring to exemplary FIG. 2*b*, a schematic diagram of thermocell layer 200 may be shown. Thermocell layer 200 may be powered by a power source 207. Power source 207 may be power generation layer 300, a battery, a combination of the two, or as desired. As described previously, passing a current through two different conductors 202 and 203 may create temperature changes at the junctions between the materials per the Peltier effect. Such temperature changes can include, but are not limited to, an increase in the local temperature at a junction between a first conductor 202 and a second conductor 203 and a decrease in temperature at an alternate junction between conductors 202, 203.

Using the Peltier effect in thermocell layer 200 may provide footwear 100 with both cooling and heating characteristics. The amount of cooling and heating provided by the thermocell layer may be controlled to desirable levels; for example, the amount of cooling and heating provided may depend on the construction of footwear 100, the choice of materials, or the amount of electrical power provided to the thermocell layer 200. For example, carbon nanotube thermocells, which may have efficiencies between 8-14%, may be suitable for general use under common winter conditions in North America and northern Europe. These thermocells may generate an amount of heat sufficient to warm feet under these common winter conditions in these locales, but generate insufficient heat to pose a risk of overheating or of burning the sole of the footwear 100 during normal use conditions. Other thermocell designs may be specifically tailored for use under other conditions, and produce levels of heating or cooling appropriate for those conditions. For example, a thermocell design may be specifically tailored for use by deep-sea fishermen, and may be constructed to have a higher efficiency than that disclosed above; another design may be specifically tailored for use by Antarctic researchers and have a higher efficiency still.

Figure 2C:
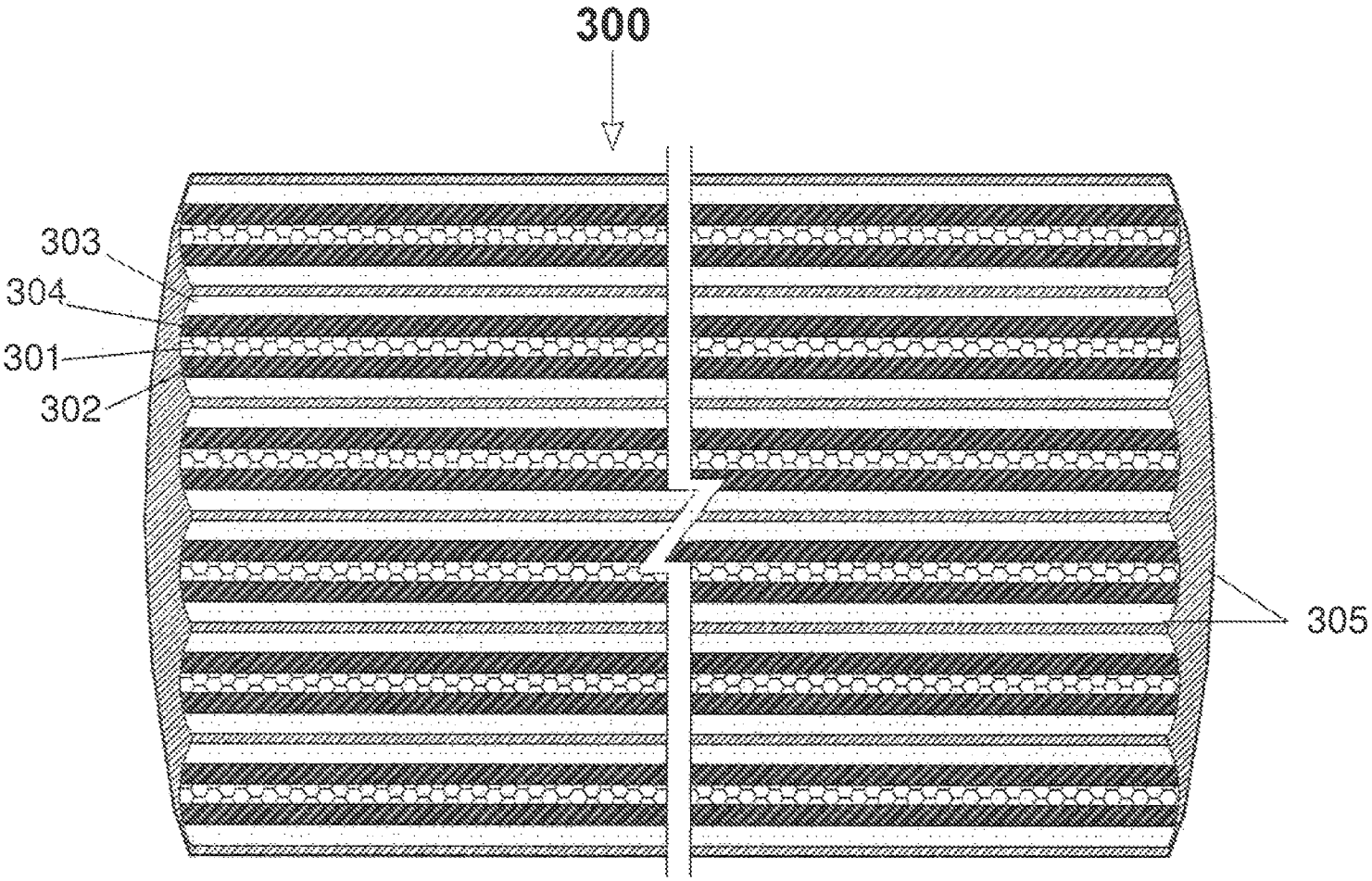
FIG. 2*c* shows a cross-section of a dielectric elastomer multi-layering.

Now referring to exemplary FIG. 2*c*, the power generation layer 300 may include a multilayering of DE materials. Each layer may have an N-P junction 302, 304 with DE material 301 sandwiched in between. An insulator 303 may insulate the layers from each other and an elastic cushioning material 305 may provide structural support and elasticity, and may protect the power generation layer 300 through the various stresses which may be encountered in normal usage of footwear 100. A power generation layer 300 with six layers is shown, but any number of layers may be used, as desired.

As a person walks, pressure may be exerted on power generation layer 300. The applied pressure on the DE material may then generate an electric current as explained above. According to at least one embodiment, multilayering the DE material may be preferred due to increasing the density of power-generating material. Electricity generated by power generation layer 300 may then be conducted to thermocell layer 200, to accessory layer 400, or as desired.

Figure 3:
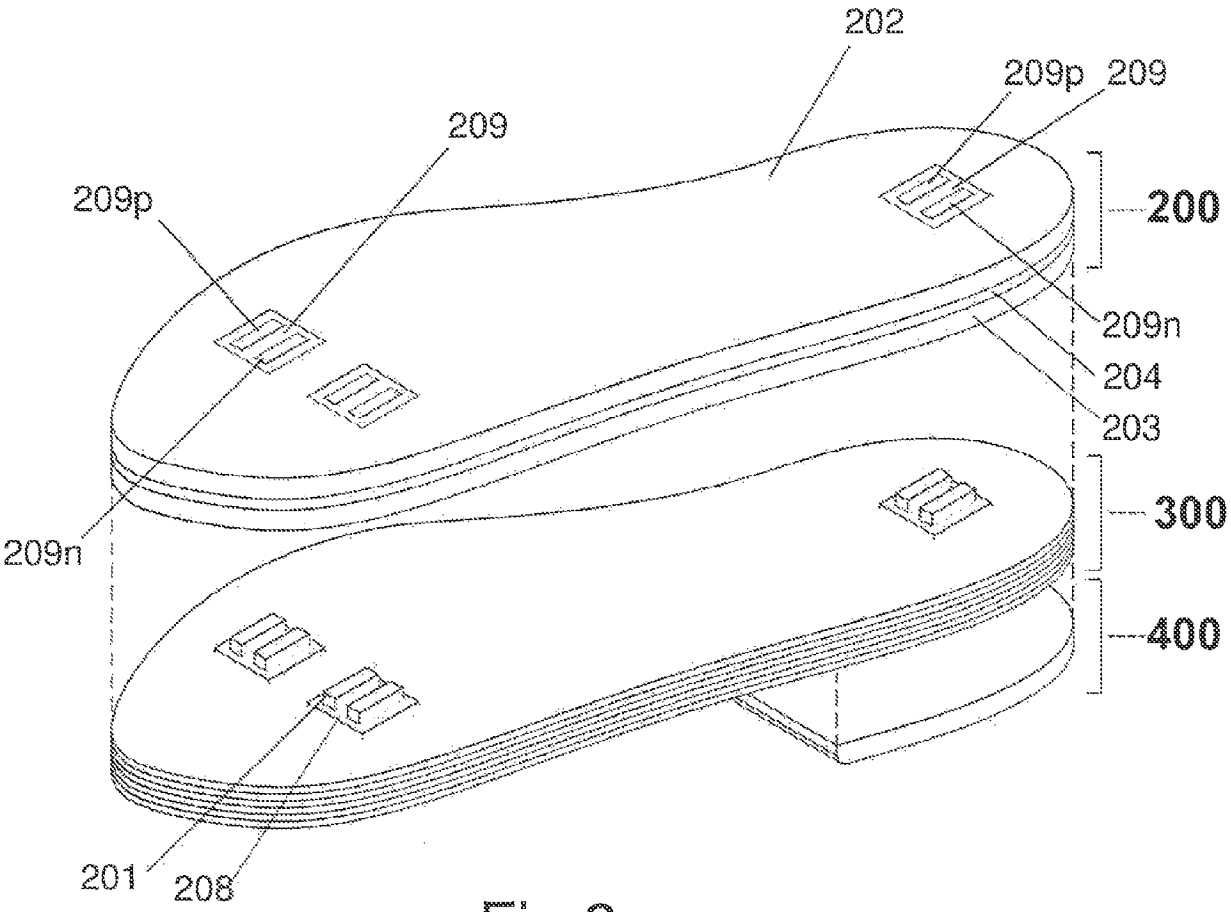
FIG. 3 shows a 3-D rendering of power generation and thermocell layering for thermal footwear.

Now referring to exemplary FIG. 3, electrodes 201 of power generation layer 300 may fit into sockets 209*n*, 209*p* of junction boxes 209 in thermocell layer 200. One or more junction boxes 209 may be used to efficiently transfer electric power from power generation layer 300 to thermocell layer 200. According to at least one exemplary embodiment, and as shown in exemplary FIG. 3, more junction boxes 209 may be disposed toward the front of footwear 100 than toward the rear. More power may be required in the front of footwear 100 in closed shoes—for example, sneakers and boots—as the extremities may lose heat more quickly in colder or wetter environments.

The thermocell layer 200 may have a coating on it to protect the DE material and any inner components during use, and may also be removable from power generation layer 300. For example, the thermocell layer 200 may be coupled to the power generation layer via a tacky adhesive or a snap-attach system, or as desired. This may allow a user to detach and reattach the thermocell layer 200 such that in one attachment configuration thermocell 200 may conduct the supplied current in such a way as to create heat on the top surface. In another attachment configuration—for example, if the thermocell 200 is turned upside-down—the thermocell 200 may conduct the supplied current in such a way as to cool the now-top surface. Additionally, the coating of the thermocell 200 may be colored differently on each side with warmer and cooler colors, or otherwise marked with any desired indicia. For example, the thermocell may be given a coloring of red on one side and blue on the other, which may communicate to the user which side—warming or cooling—is face-up. Alternatively, only one side of the thermocell may be marked, or symbols may be used instead.

Thus, footwear 100 may be used in both a winter and summer application by adjusting the thermocell 200. The thermocell 200 and the power generation layer 300 may additionally be integrated as an insert or add-on technology for use with pre-existing footwear. Either as an insert or as a stand-alone footwear system, the footwear 100 may be capable of both warming and cooling feet but also may provide cushioning comfort to a user in a similar fashion as an orthotic insert. Because the power generation layer 300 may compress and decompress in usage, its relative elasticity may be configured to provide a desired optimal balance of cushioning and temperature regulation via thermocell 200.

Figure 4:
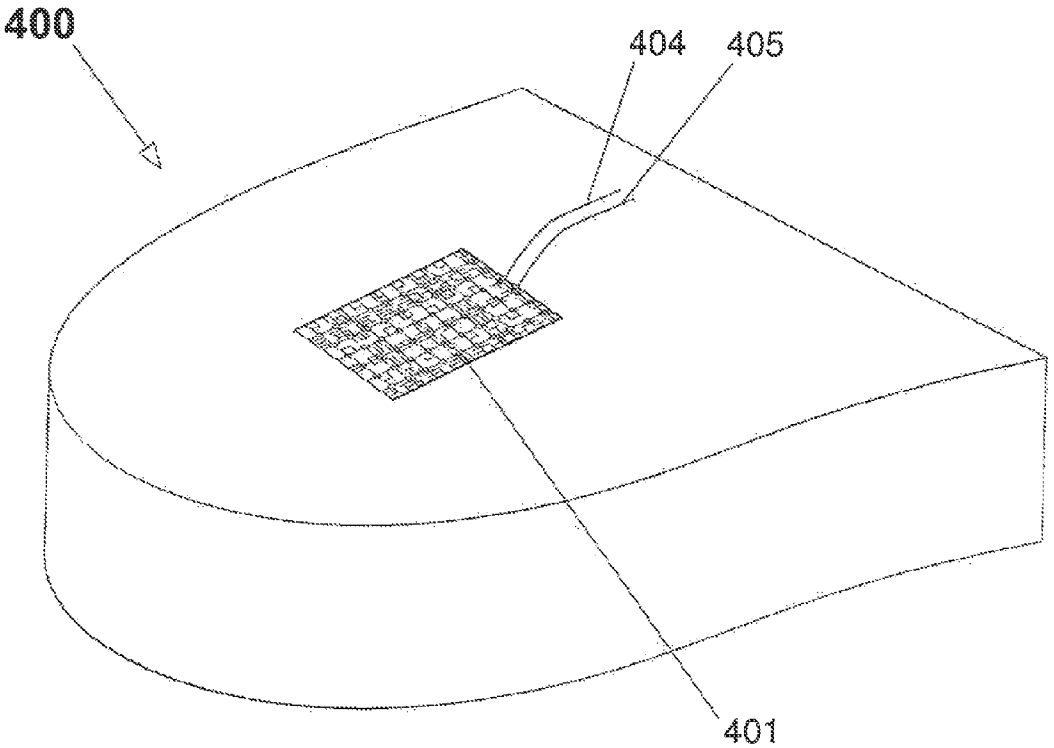
FIG. 4 shows an integrated chip for power transmission external of the thermal footwear.
Figure 4A:
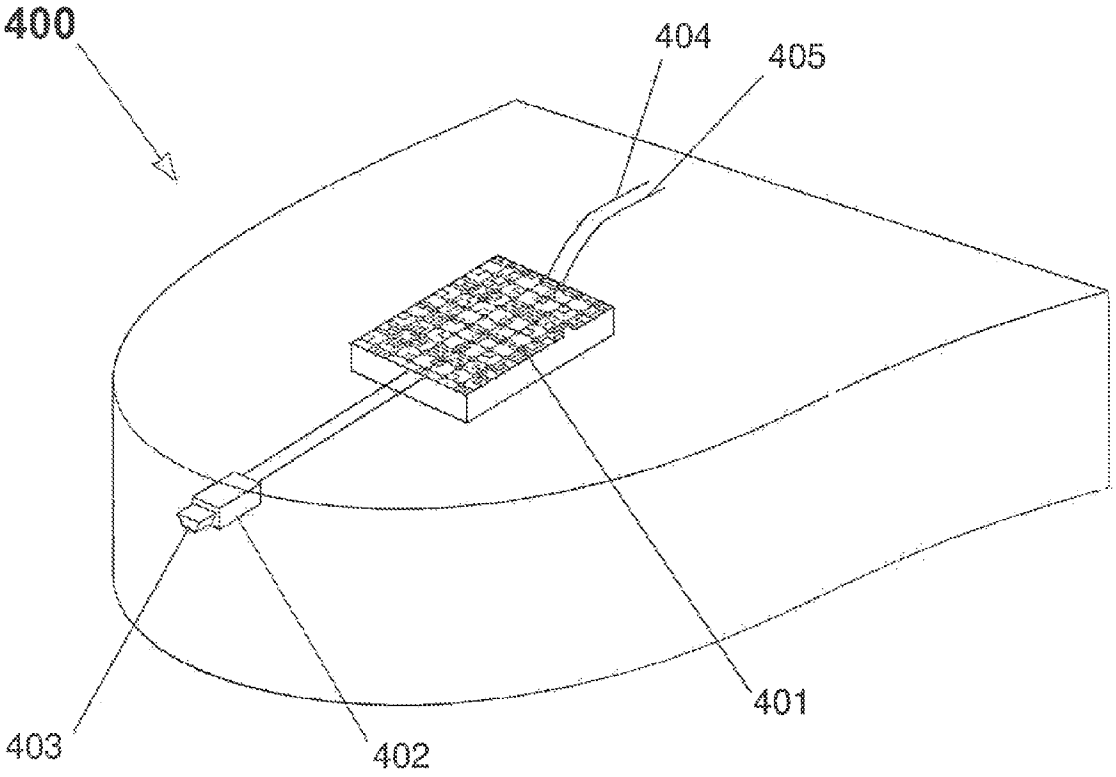
FIG. 4*a* shows an alternative embodiment of an integrated chip for power transmission.

Now referring generally to exemplary FIGS. 4 and 4*a*, because DE material has a high potential of power density, according to some embodiments generated power may also be used to recharge small appliances, such as, for example, cell phones and laptops. Exemplary FIG. 4 shows accessory layer 400 with an integrated circuit chip 401 for wireless power transmission. Chip 401 may be one of any known chips which provide wireless power transmission, which can function, for example, to power or recharge small appliances. Wires 404, 405 may connect chip 401 to power generation layer 300. Exemplary FIG. 4*a* shows an alternative embodiment with a manual socket 402 for power output. Socket 402 may be, for example, a mini-USB connector. Socket 402 may extend through socket opening 403 and may be configured to connect with one or more electronic components. Accessory layer 400 may additionally include other components as one of ordinary skill in the art would recognize as useful in the use of footwear 100; for example, a battery for storing power, a control switch for turning on/off the power generation capabilities, an indicator of power generation such as an LED display, or any other such components that are desired may be used.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for thermally-regulating footwear, comprising:

a thermocell layer with a first side and a second side, a power generation layer, at least two electrodes coupled to the power generation layer, and at least one junction box disposed in the thermocell layer, wherein the power generation layer further comprises a plurality of sub-layers, each sublayer comprising a dielectric elastomer material and an insulator, the dielectric elastomer generating a current when compressed or decompressed, and the thermocell layer comprises a first conductor and a second conductor, wherein the first conductor and the second conductor are in electrical communication with each other such that when a current is passed through the first conductor and the second conductor, there is an increase in the local temperature of at least one of the junctions between the first conductor and the second conductor and a decrease in the local temperature of at least one of the junctions between the first conductor and the second conductor, wherein the junction box accepts the at least two electrodes such that in accepting the at least two electrodes, an N-P junction is created, wherein the power generation layer provides power to the thermocell layer, and wherein the thermocell layer is configured to provide at least one of warming and cooling.

2. The apparatus for thermally-regulating footwear of claim 1, wherein the thermocell layer and the power generation layer are disposed in the sole of the footwear.

3. The apparatus for thermally-regulating footwear of claim 1, further comprising an integrated circuit chip, wherein the integrated circuit chip transmits power externally from the footwear.

4. The apparatus for thermally-regulating footwear of claim 3, wherein the integrated circuit chip transmits power wirelessly.

5. The apparatus for thermally-regulating footwear of claim 3, wherein the integrated circuit chip transmits power via a wired connection.

6. The apparatus for thermally-regulating footwear of claim 1, comprising at least three of said junction boxes, wherein a majority of the junction boxes are disposed proximate to a toe end of the footwear.

7. The apparatus for thermally-regulating footwear of claim 1, wherein the thermocell layer is reversibly coupled to the power generation layer.

8. The apparatus for thermally-regulating footwear of claim 7, wherein the thermocell layer is reversibly coupled to the power generation layer via a snap-attach system.

9. The apparatus for thermally-regulating footwear of claim 7, wherein the thermocell layer is coupled to the power generation layer via either the first side or the second side, and wherein when a current is passed through the thermocell layer, the thermocell layer creates a warming effect on the first side and a cooling effect on the second side.

10. The apparatus for thermally-regulating footwear of claim 8, wherein the first side and the second side of the thermocell layer are marked with two different colors.

11. The apparatus for thermally-regulating footwear of claim 1, further comprising a battery that stores excess power generated by the power generation layer.

12. The apparatus for thermally-regulating footwear of claim 1, wherein the power generation layer provides for power generation and cushioning.

13. A thermally-regulating insert for use in footwear, the thermally-regulating insert comprising:

a thermocell layer with a first side and a second side, and a power generation layer, the power generation layer further comprises a plurality of sub-layers, each sublayer comprising a dielectric elastomer material and an insulator, the dielectric elastomer generating a current when compressed or decompressed, the thermocell layer comprises a first conductor and a second conductor, at least two electrodes coupled to the power generation layer, and at least one junction box disposed in the thermocell layer, wherein the first conductor and the second conductor are in electrical communication with each other such that when a current is passed through the first conductor and the second conductor, there is an increase in the local temperature of at least one of the junctions between the first conductor and the second conductor and a decrease in the local temperature of at least one of the junctions between the first conductor and the second conductor, wherein the power generation layer is configured to provide power to the thermocell layer, wherein the junction box is configured to accept the at least two electrodes such that in accepting the at least two electrodes, an N-P junction is created, wherein the insert is sized and shaped to fit into a user's footwear, and wherein the thermocell layer is configured to provide at least one of warming and cooling.

14. The article of footwear of claim 13, comprising at least three of said junction boxes, wherein a majority of the junction boxes are disposed proximate to a toe end of the thermally-regulating insert.

15. The article of footwear of claim 13, wherein the thermocell layer is reversibly coupled to the power generation layer.

16. The article of footwear of claim 15, wherein the thermocell layer is configured to couple to the power generation layer via either the first side or the second side, and wherein when a current is passed through the thermocell layer, the thermocell layer creates a warming effect on the first side and a cooling effect on the second side.

17. The article of footwear of claim 13, wherein the first side and the second side of the thermocell layer are marked with two different colors.

18. The article of footwear of claim 13, wherein the power generation layer provides for power generation and cushioning.

* * * * *